US007171914B2

(12) United States Patent
Ota et al.

(10) Patent No.: US 7,171,914 B2
(45) Date of Patent: Feb. 6, 2007

(54) HORIZONTAL ROTARY HOOK FOR SEWING MACHINE

(75) Inventors: Shin Ota, Inazawa (JP); Akifumi Nakashima, Ichinomiya (JP); Kenichi Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 23 days.

(21) Appl. No.: 11/230,522

(22) Filed: Sep. 21, 2005

(65) Prior Publication Data

US 2006/0065175 A1 Mar. 30, 2006

(30) Foreign Application Priority Data

Sep. 28, 2004 (JP) ..... 2004-281375

(51) Int. Cl.
*D05B 57/26* (2006.01)

(52) U.S. Cl. ..... 112/231

(58) Field of Classification Search ..... 112/228–231, 112/232, 180, 181–196; 57/75; 242/170, 242/171, 118, 130, 134, 137
See application file for complete search history.

(56) References Cited

U.S. PATENT DOCUMENTS 2,394,369 A * 2/1946 Colegrove ..... 112/228
3,347,193 A * 10/1967 Perri ..... 112/228
3,581,687 A * 6/1971 Meier et al. ..... 112/279
3,851,448 A * 12/1974 Sano et al. ..... 57/75
4,429,649 A * 2/1984 Eguchi et al. ..... 112/229
4,676,178 A * 6/1987 Hirose ..... 112/231

FOREIGN PATENT DOCUMENTS

JP A 7-112088 5/1995
JP A 8-24461 1/1996

* cited by examiner

*Primary Examiner*—Ismael Izaguirre
(74) *Attorney, Agent, or Firm*—Oliff & Berridge, PLC.

(57) ABSTRACT

A horizontal rotary hook of a sewing machine includes an inner rotary hook made of synthetic resin and housing a bobbin, an outer rotary hook made of synthetic resin and housing the inner rotary hook and rotated in a predetermined direction, an adsorption plate made of a magnetic material and mounted on one of an outer surface of a bottom wall of the inner rotary hook and an inner surface of a bottom wall of the outer rotary hook, a magnet piece formed as a thin plate and mounted in the other of the outer surface of the bottom wall of the inner rotary hook and the inner surface of the bottom wall of the outer rotary hook, and a yoke member made of a magnetic material and housing the magnet piece integrally formed with a bottom wall contacting the magnet piece and a wall surrounding an outer circumferential side of the magnet piece. The yoke member is mounted on the other of the outer surface of the bottom wall of the inner rotary hook and the inner surface of the bottom wall of the outer rotary hook.

6 Claims, 6 Drawing Sheets

HORIZONTAL ROTARY HOOK FOR SEWING MACHINE

CROSS-REFERENCE TO RELATED APPLICATIONS

This application is based upon and claims the benefit of priority from the prior Japanese Patent Application No. 2004-281375, filed on Sep. 28, 2004 the entire contents of which are incorporated herein by reference.

BACKGROUND OF THE INVENTION

1. Field of the Invention

The present invention relates to a horizontal rotary hook of a sewing machine provided with an inner rotary hook and an outer rotary hook respectively made of synthetic resin wherein the inner rotary hook is pulled toward the outer rotary hook by the magnetic force of a thin plate-shaped magnet piece.

2. Description of Prior Art

Conventionally, horizontal rotary hooks offering simple and handy bobbin exchange have been widely used. Such types of horizontal rotary hooks are provided with an outer rotary hook formed with a race surface and an inner rotary hook housing a bobbin retained rotatably in relative to the race surface. The outer rotary hook is rotated in a predetermined direction by a sewing machine motor or the like.

The inner rotary hook is made of a synthetic resin to achieve reduction of weight and manufacturing cost. Also, in recent years, the outer rotary hook is also made of a synthetic resin. Such being the case, various types of horizontal rotary hooks using magnets have been proposed to prevent the inner rotary hook from floating up with respect to the outer rotary hook during sewing work. For example, JP-Y1-1989-54784 discloses a horizontal rotary hook having an outer rotary hook embedded with a thin ring-shaped magnet in the inner bottom surface thereof as well as having an inner rotary hook with the outer bottom surface almost entirely covered with a metal material which is attracted by the magnet.

However, a simple provision of a magnet in the outer rotary hook made of synthetic resin would limit the magnet to a relatively small size, consequently providing insufficient attraction with respect to the inner rotary hook. As a result, the floating of the inner rotary hook is not prevented effectively. Such being the case, mounting of a large type magnet generating strong magnetic force on the outer rotary hook is a possible alternative; however, such countermeasures give rise to problems such as cost and size increase of the horizontal rotary hook. In the outer rotary hook made of synthetic resin, the magnet needs to be fixed to the bottom surface of the outer rotary hook by an adhesive agent or a two-sided adhesive tape. However, this will result in complicated assembly work and furthermore, since the magnet is of small size, consequently having small adhesion area incapable of providing enough adhesion, problems have occurred where the magnet fell off while in use.

SUMMARY OF THE INVENTION

The purpose of the present invention is to provide a horizontal rotary hook of a sewing machine capable of obtaining sufficient attraction between an inner rotary hook and an outer rotary hook while restraining the size increase of the entire construction.

The horizontal rotary hook of the present invention includes an inner rotary hook made of synthetic resin and housing a bobbin; an outer rotary hook rotationally driven to a predetermined direction and housing the inner rotary hook and an adsorption plate made of a magnetic material provided on one of the outer surface of the bottom wall of the inner rotary hook and the inner surface of the bottom wall of the outer rotary hook. The horizontal rotary hook of the present invention further includes a thin plate-shaped magnet piece to pull the adsorption plate provided on the other of the outer surface of the bottom wall of the inner rotary hook and the inner surface of the bottom wall of the outer rotary hook; and a yoke member made of a magnetic material housing the magnet piece.

The yoke member is integrally formed with a bottom wall contacting the magnet piece and a surrounding wall surrounding the outer circumference of the magnet piece. In the present invention, the floating of the inner rotary hook from the outer rotary hook is prevented by pulling the inner rotary hook toward the outer rotary hook by a magnetic attraction between the adsorption plate made of and the thin plate-shaped magnet piece. At this point, since the magnet piece is provided in a housed state in the yoke member integrally formed with a bottom wall and a surrounding wall, a magnetic path is formed extending from the top surface of the magnet piece to the bottom surface of the magnet piece via the adsorption plate, the surrounding wall, the bottom wall of the yoke member and the bottom surface of the magnet piece. Hence, even if the magnet piece is relatively small, the magnetic attraction between the magnet piece and the adsorption plate can be increased, thereby increasing the magnetic force to pull the inner rotary hook toward the outer rotary hook.

In the present invention, considering the mounting space and ease of assembly, it is desirable to provide the adsorption plate in the outer surface of the bottom wall of the inner rotary hook and provide the magnet piece and the yoke member in the inner surface of the bottom wall of the outer rotary hook. Also, by locking the yoke member with a collar plate of the outer rotary hook shaft, the magnet piece and the yoke member can be mounted on the outer rotary hook without using an adhesive agent or a adhesive tape.

BRIEF DESCRIPTION OF THE DRAWINGS

Other objects, features and advantages of the present invention will become clear upon reviewing the following description of the embodiment example with reference to the accompanying drawings, in which.

DETAILED DESCRIPTION OF THE INVENTION

An embodiment of the present invention is described hereinafter with reference to the drawings. The present embodiment is an example applying the present invention to a horizontal full rotary hook rotatably driven continuously in one direction.

First, an overall construction of a sewing machine according to the present embodiment is described with reference to FIGS. 1A and 1B.

Figure 1A:
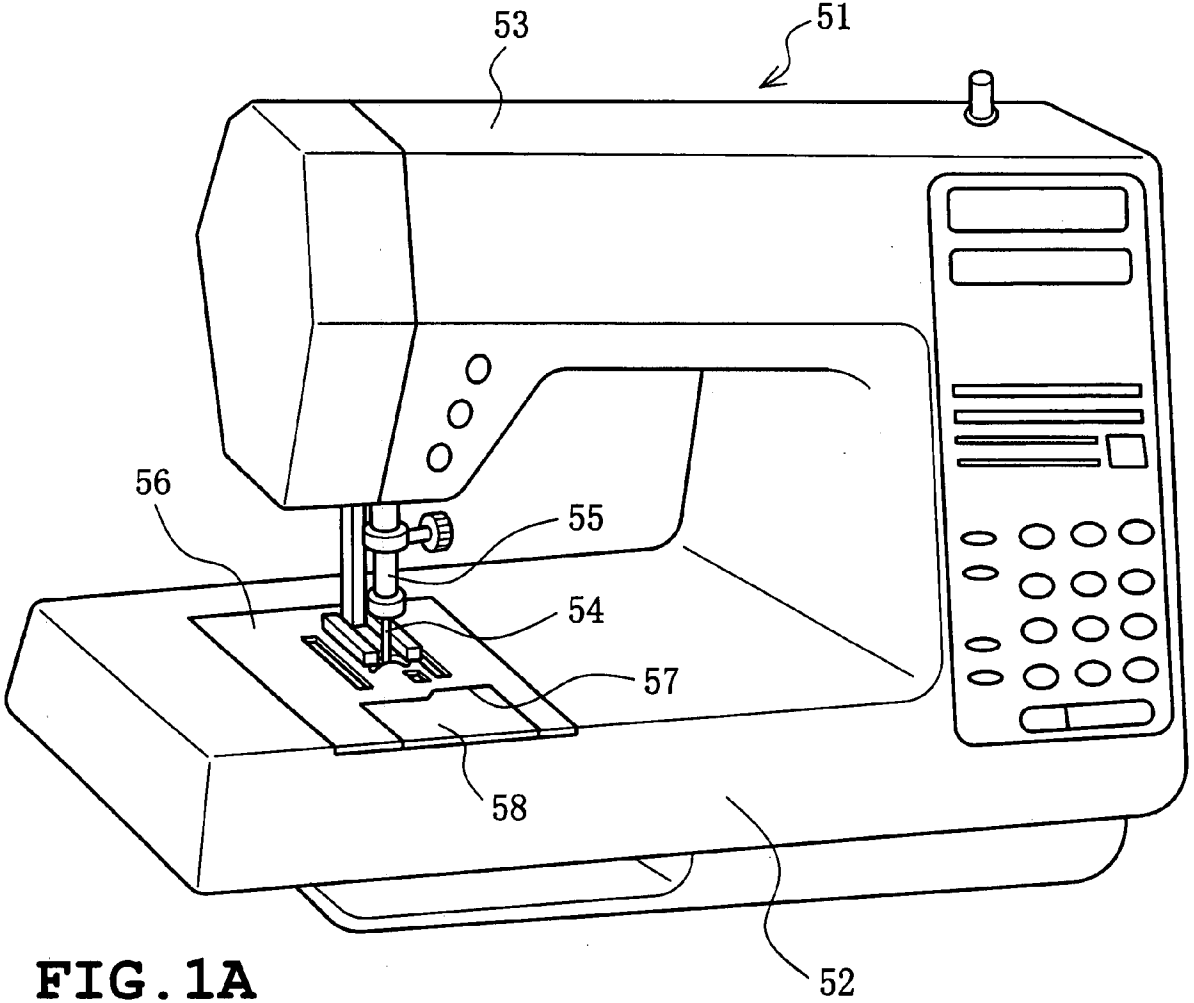
FIG. 1A is a perspective overview of a sewing machine showing an embodiment of the present invention.
Figure 1B:
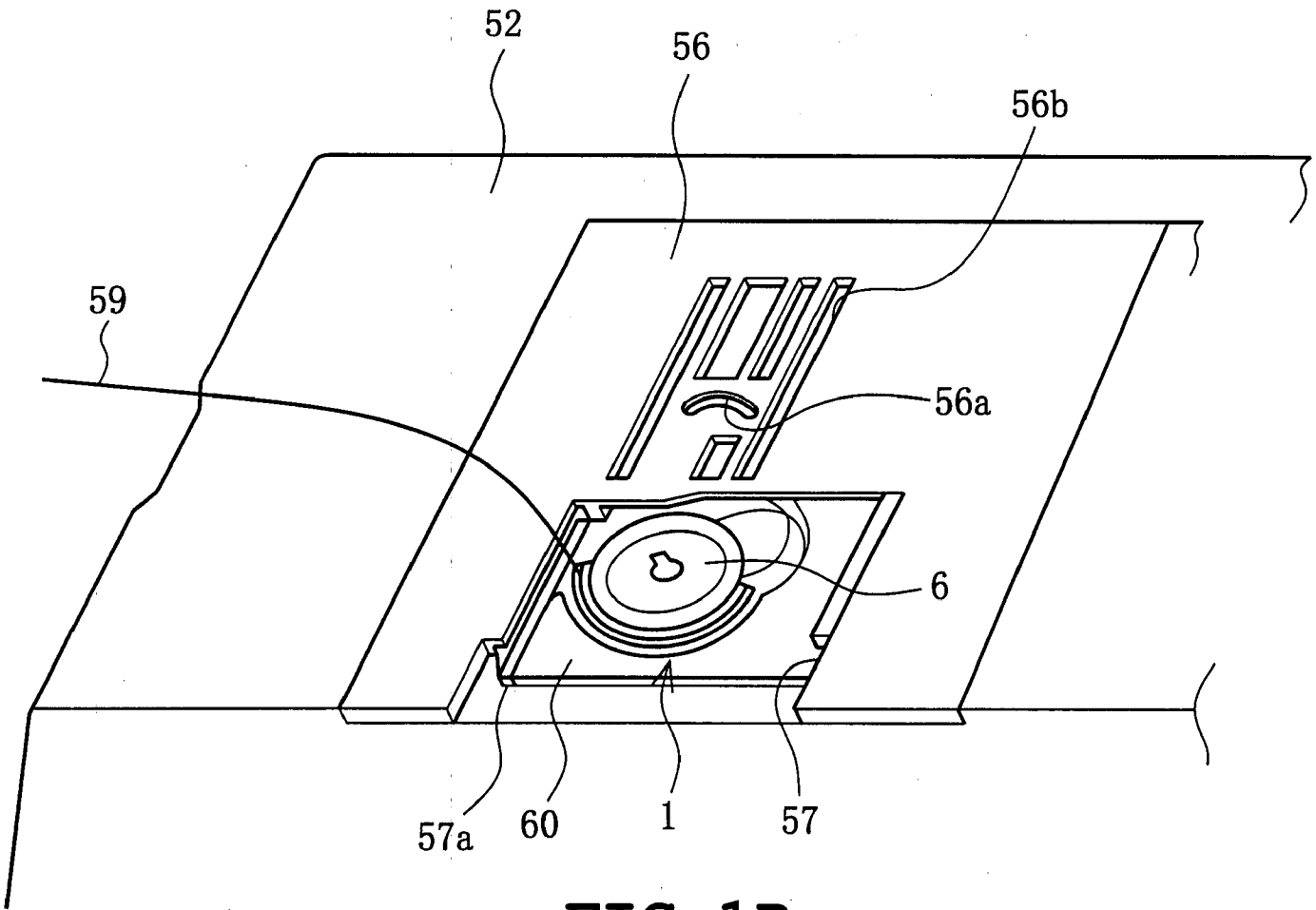
FIG. 1B is an enlarged perspective view of a needle plate.

The sewing machine body 51 as shown in FIG. 1A is integrally formed with an arm 53 above the bed 52. A needle bar 55 having a sewing needle 54 is provided on a distal end of the arm 53 and is vertically moved by a driving mechanism not shown. On the other hand, as also shown in FIG. 1B, a metal needle plate 56 is provided on the upper surface of the bed 52 opposing the needle bar 55. On the needle plate 56 are formed a needle hole 56*a* through which the needle bar 55 penetrates and plurality of long holes 56*b* for operation of a feed dog not shown. Also, a bobbin accommodation hole 57 having an oblong opening is formed in front of the aforementioned needle hole 56*a* and the long holes 56*b*. The bobbin accommodation hole 57 is slidably opened/closed in a front/rear direction by a transparent sliding lid 58 (refer to FIG. 1A) which is inserted into two sliding grooves 57*a* located in the left and right portions of the bobbin accommodation hole 57 respectively. Only one of the sliding grooves 57*a* is shown in FIG. 1B.

Inside the bed 52 is provided a cloth feed mechanism (not shown) to drive the feed dog in synchronization with the vertical movement of the needle bar 55 is provided. A horizontal full rotary hook 1 according to the present invention is also provided inside the bed 52. The hook 1 is located in the lower portion of the accommodation hole 57 of the needle plate 56 and supplies a bobbin thread 59 as well as executing the sewing work in co-operation with the sewing needle 54.

As described in detail hereinafter, this horizontal full rotary hook 1 includes an outer rotary hook 2 (refer to FIG. 2) having a tip member 4 which rotates in a horizontal direction in synchronization with the vertical movement of the needle bar 55 and an inner rotary hook 3 (refer to FIG. 2) provided in the outer rotary hook 2 in an unrotatable state with respect to the bed 52. As shown in FIG. 1B, a bobbin 6 wound with the bobbin thread 59 is removably housed inside the inner rotary hook 3. Also, on the bottom surface of the needle plate 56, a plastic work clamp 60 is provided in the area of the accommodation hole 57. An opening is provided on the work clamp 60 for removing the bobbin 6 and also, though not shown, a rotation restrictor to prevent the rotation of the inner rotary hook 3 is provided on the bottom surface of the work clamp 60.

Hence, owning to a counterclockwise rotation of the outer rotary hook 2 about the outer circumference of the inner rotary hook 3 in synchronization with the vertical movement of the needle bar 55, a loop of needle thread not shown formed under the needle hole 56*a* by the sewing needle 54 is captured by the tip member 4. Then, the loop is pulled around the exterior of the inner rotary hook 3 and forms a stitch with the bobbin thread 59.

Figure 4:
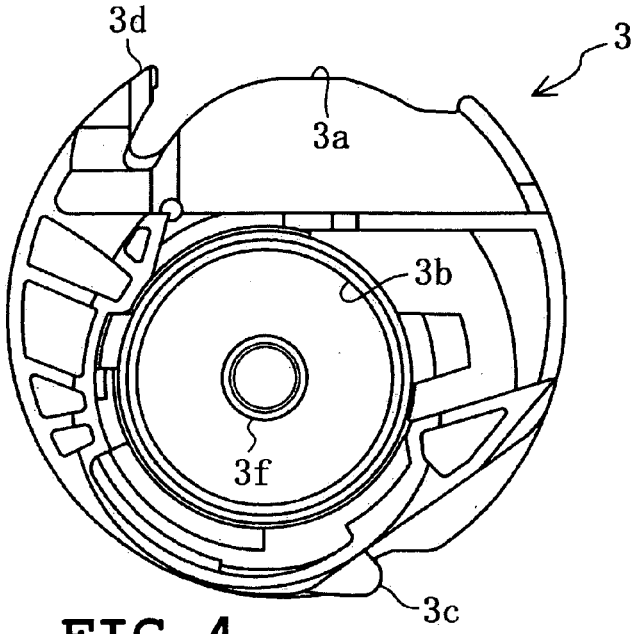
FIG. 4 is a plan view of an inner rotary hook.
Figure 5:
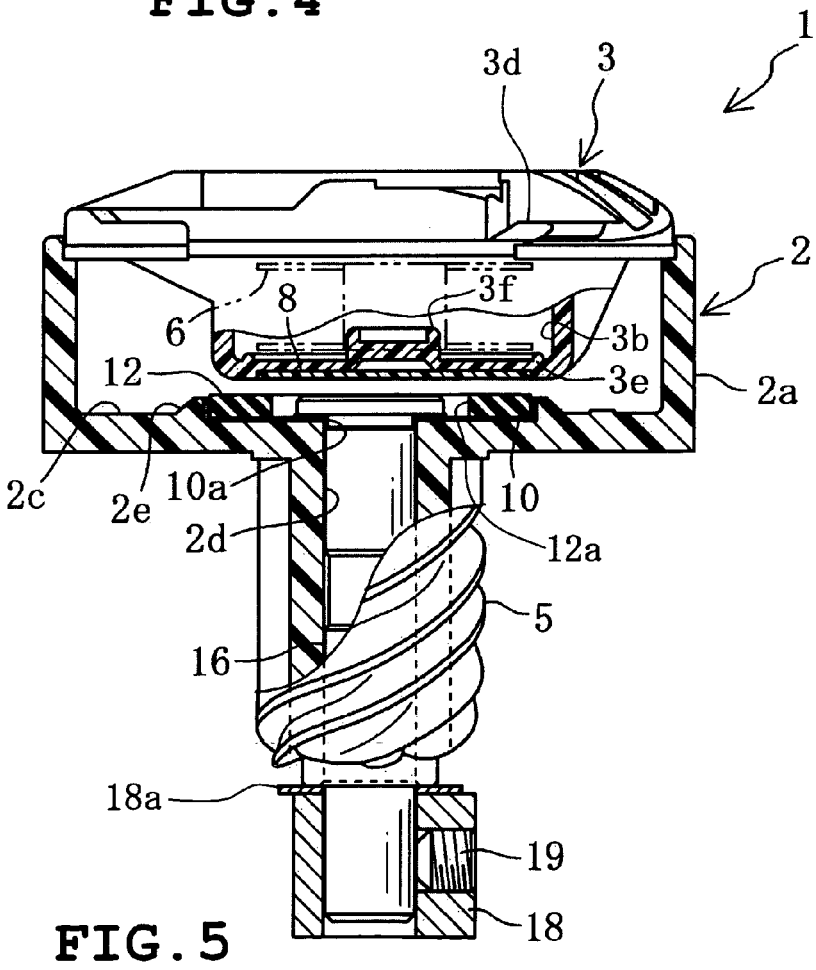
FIG. 5 is a vertical sectional side view of the horizontal full rotary hook.

Now, the horizontal full rotary hook 1 will be described in detail with reference to FIGS. 2 to 7. First, the inner rotary hook 3 will be described. As shown in FIGS. 4 and 5, the overall inner rotary hook 3 is formed as an approximate circular container with a shallow bottom made of synthetic resin material (for example a polyimide). The inside portion of the inner rotary hook 3 will be referred to as a bobbin housing 3*b* to house the bobbin 6 and in the central portion of a bottom wall 3*e*, a shaft 3*f* to which the bobbin 6 is inserted rotatably is provided.

As shown in FIG. 4, a rotation restrictor 3*c* is provided on the near side of the outer circumferential portion of the inner rotary hook 3 to prevent the rotation of the inner rotary hook 3. Also, a notch 3*a* allowing the needle 54 to pass therethrough is provided in the far side of the outer circumferential portion of the inner rotary hook 3. A protruding thread guide 3*d* is formed on one end of the notch 3*a*. Furthermore, on the inner wall of the bobbin housing 3*b*, a tension generator (not shown) is provided to apply tension to the bobbin thread 59. The tension generator comprises an arc-shaped thread tension plate and an arc-shaped thread tension spring both laid one upon the other.

In the present embodiment, as shown in FIG. 5, a circular adsorption plate 8 made of a magnetic material such as a steel plate is provided on an outer surface (or an underside) of the bottom wall 3*e* so as to be coplanar with the underside. In this case, the adsorption plate 8 is adhered to the inner rotary hook 3 by a two-sided adhesive tape, for example.

Figure 6:
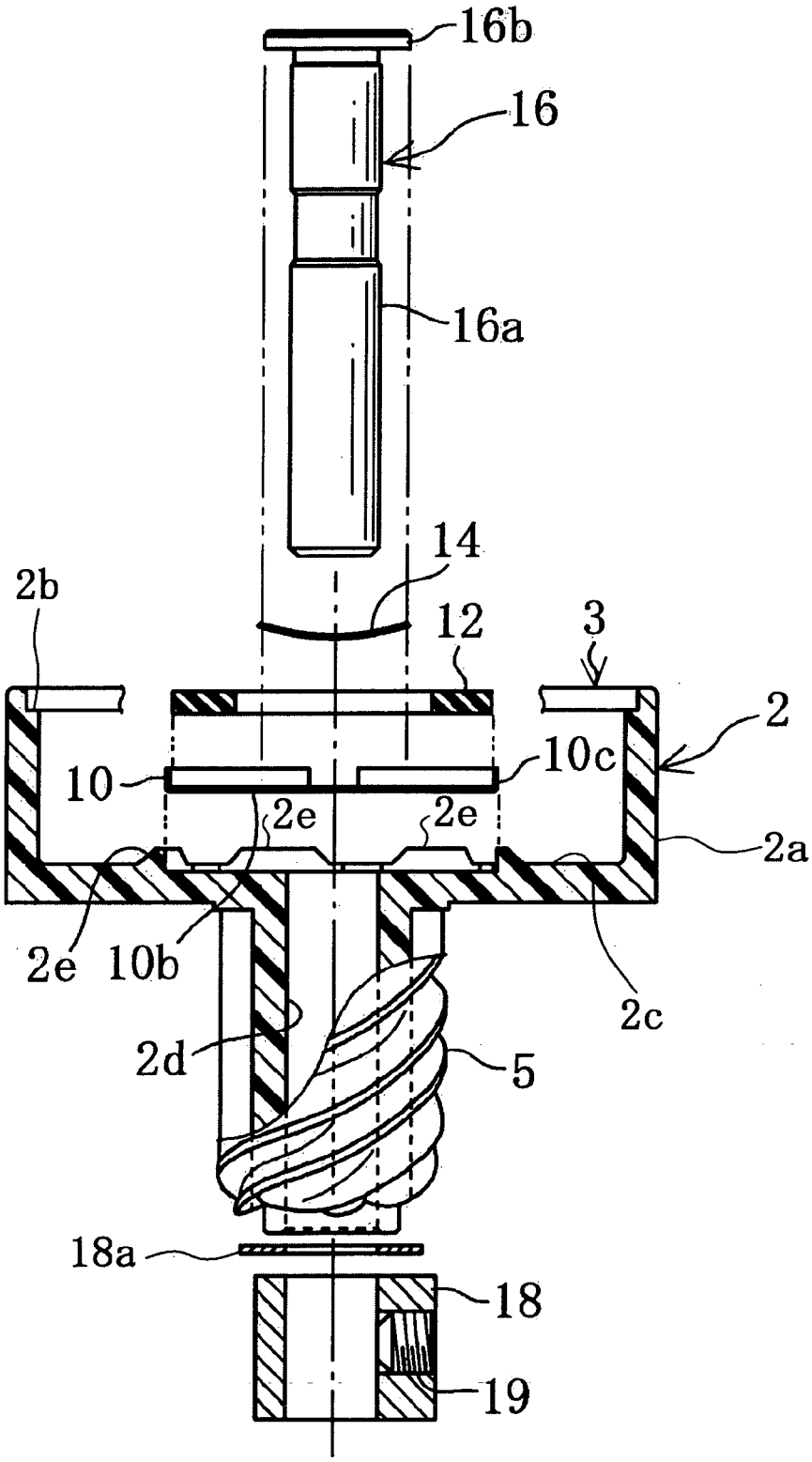
FIG. 6 is an exploded vertical sectional side view of each part constructing the outer rotary hook.

As opposed to this, the outer rotary hook 2 is constructed as follows. That is, as shown in FIGS. 5 and 6, the outer rotary hook 2 is made of a synthetic resin material, for example, a polyimide resin formed as a cylindrical container with an opened upper surface and in more detail, is integrally formed with a disc-shaped bottom wall 2*c* and an outer circumferential wall 2*a* rising up from the outer circumference. This outer rotary hook 2 is to have a slightly larger diameter than the inner rotary hook 3.

Figure 2:
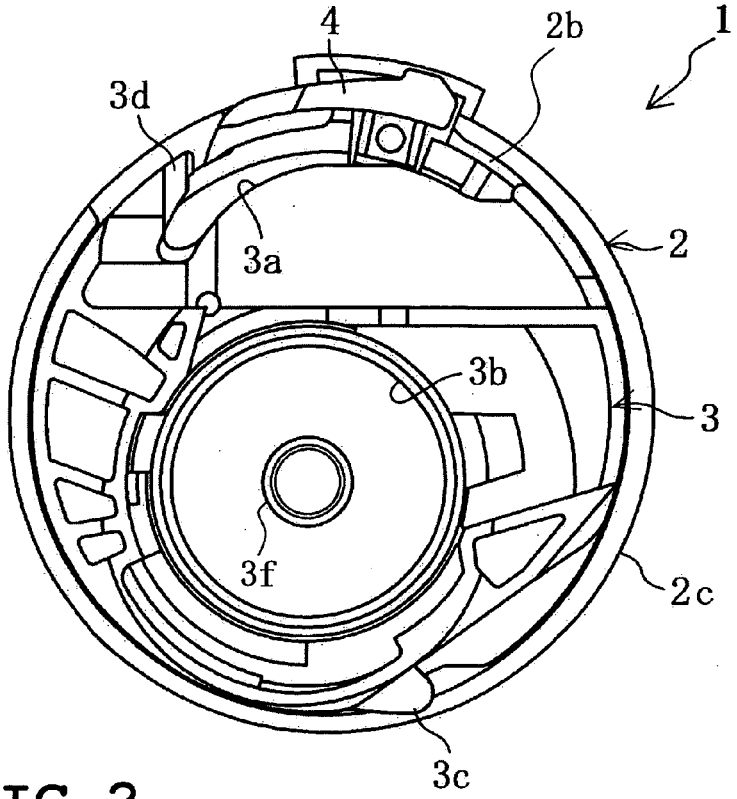
FIG. 2 is a plan view of a horizontal full rotary hook.
Figure 3:
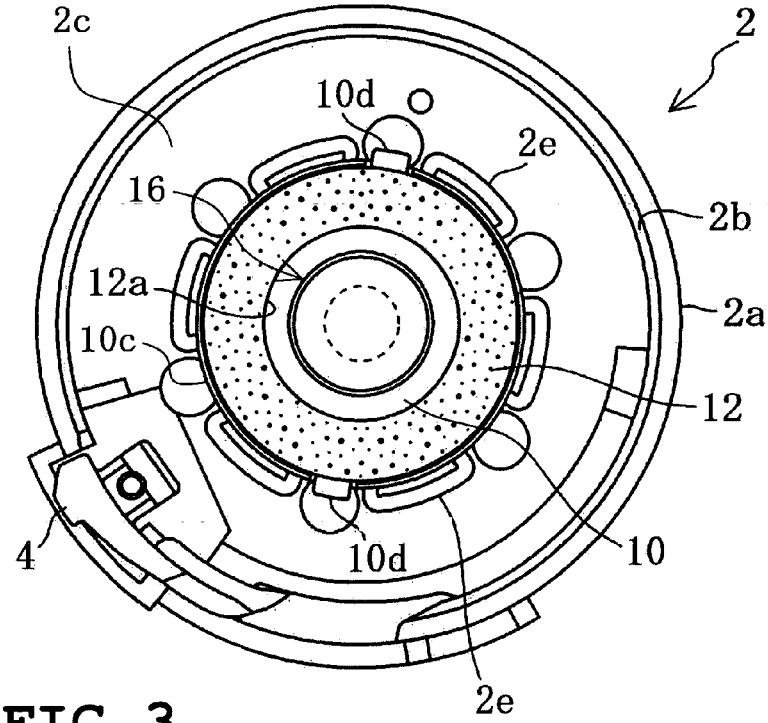
FIG. 3 is a plan view of an outer rotary hook.

As shown in FIG. 3, a part of the outer circumferential wall 2*a* of the outer rotary hook 2 is removably mounted with the tip member 4 in a separate, synthetic resin body. Also, an annular race surface 2*b* having a lowered inner circumference is formed on an upper edge of the outer circumferential wall 2*a* so as to extend over the entire circumference. As shown in FIG. 2, the bottom surface of the outer circumferential end of the inner rotary hook 3 is formed to be slidably placed on the race surface 2*b*. Hence, as shown in FIG. 5, the inner rotary hook 3 is housed in the outer rotary hook 2 with the bottom wall 3*e* in a floated state.

Furthermore, the outer rotary hook 2 is integrally formed with a drive shaft 5 extending downward from the central portion of the bottom (bottom wall 2*c*) of the outer rotary hook 2. The drive shaft 5 is in the form of a tube having vertically penetrating shaft slot 2*d* therethrough as well as having a gear portion in the form of a warm gear on the outer circumference. As shown in FIGS. 5 and 6, the outer rotary hook 2 is mounted rotatably to a fixing portion 18 of a sewing machine frame by an outer rotary hook shaft 16.

This outer rotary hook shaft 16 is integrally formed with a collar plate 16*b* on the upper end of a shaft body 16*a* which is inserted into the shaft slot 2*d*. As shown in FIG. 5, the outer rotary hook shaft 16 inserted into the shaft slot 2*d* rotatably supports the outer rotary hook 2 by fixing the lower end of the outer rotary hook shaft 16 to the fixing portion 18 of the sewing machine frame (the bottom of the bed 52) by a screw 19. Also, a rotary hook drive mechanism not shown has a drive gear in mesh engagement with a gear portion of the drive shaft 5, so that the outer rotary hook 2 is rotated via the drive gear and the drive shaft 5.

A thin plate-shaped magnet piece 12 that pulls the adsorption plate 8 is provided on an inner surface (upper surface) of the bottom wall 2*c* of the outer rotary hook 2 and housed in a yoke member 10.

Figure 7:
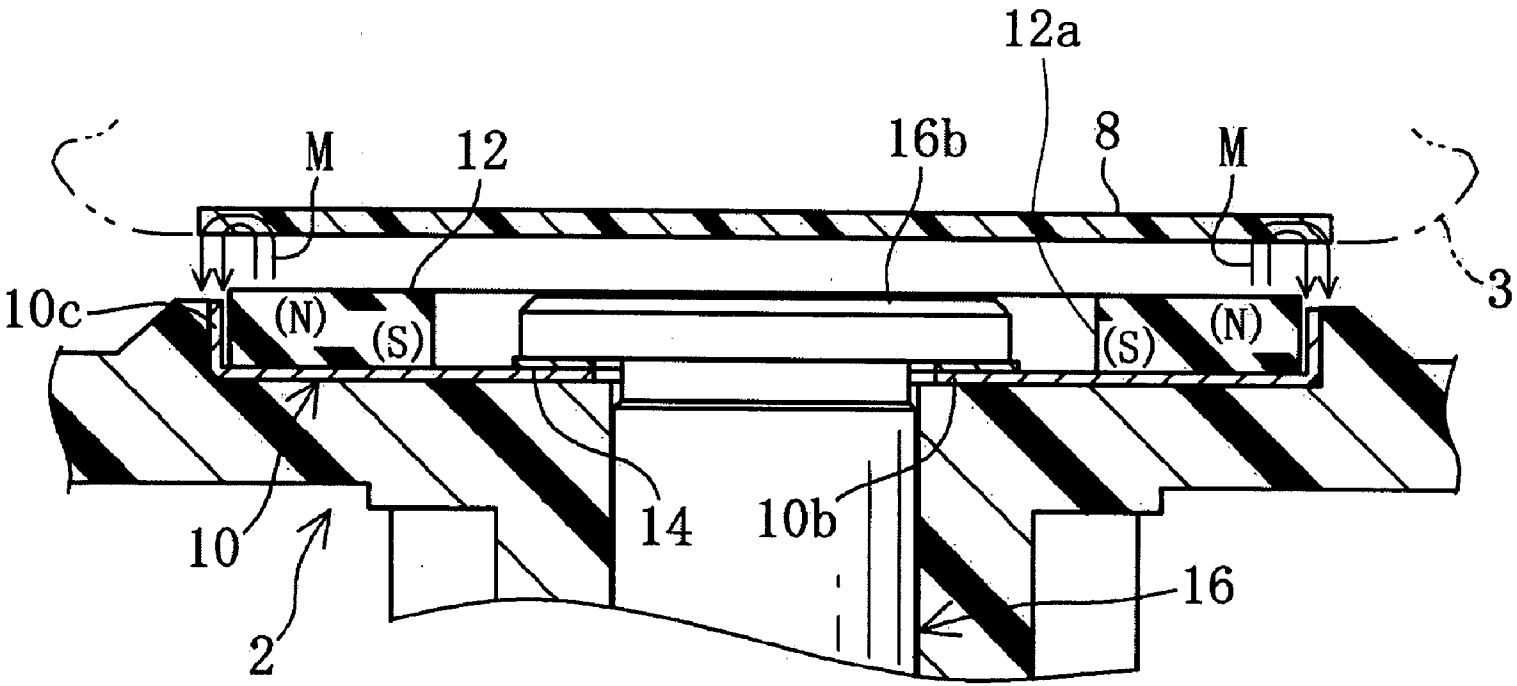
FIG. 7 is an enlarged vertical sectional side view of the magnet piece.

The magnet piece 12 is formed into the shape of a ring and has a notch 12*a* in the central portion. As shown in FIGS. 5 and 7, the notch 12*a* is set to have a larger diameter than the collar plate 16*b* of the outer rotary hook shaft 16. Also, this magnet piece 12 has different magnetic poles in the top and bottom sides and as shown in FIG. 7, the upper surface is magnetized as a north (N) pole and the lower surface is magnetized as a south (S) pole.

On the other hand, the yoke member 10 is made of a magnetic material, for example, a thin steel plate and is formed as a circular container with a shallow bottom integrally formed with a bottom wall 10*b* contacting the lower surface of the magnet piece 12 (magnet piece 12 is placed thereon) and a surrounding wall 10*c* surrounding the outer circumferential side of the magnet piece 12 in the same height as the magnet piece 12. Also, as shown in FIG. 5, the bottom wall 10*b* of the yoke member 10 has an insertion hole 10*a* formed in the center thereof. The diameter dimension of the insertion hole 10*a* is larger than the outer diameter of the shaft body 16*a* of the outer rotary hook shaft 16 and smaller than the outer diameter of the collar plate 16*b*.

As shown in FIGS. 3 and 6, locating ribs are provided on the inner surface of the bottom wall 2*c* of the outer rotary hook 2 so as to surround the outer circumference of the yoke member 10. That is, the ribs are composed of a plurality of, for example, 6 rib pieces 2*e* approximately equally spaced apart, altogether arranged in an annular form.

As opposed to this, on the outer circumference of the yoke member 10, protrusions 10*d* locked by the ribs to restrict the rotation with respect to the outer rotary hook 2 are provided. The protrusions 10*d* in more detail are formed such that the portion opposing the surrounding wall 10*c* is partially protruded outward. The lock between the protrusions 10*d* and the rib pieces 2*e* prevents the rotation of the yoke member 10 with respect to the outer rotary hook 2.

The yoke member 10 of such construction is, as shown in FIGS. 5 to 7, placed on the bottom wall 2*c* (within the rib pieces 2*e*) where the yoke member 10 is locked unmovably to the upper direction, that is, to the axial direction of the outer rotary hook shaft 16 by pressing the surrounding portions of the insertion hole 10*a* with the collar plate 16*b* formed on the outer rotary hook shaft 16. The magnet piece 12 is fitted into the yoke member 10 and fixed by the magnetic adsorption between the yoke member 10.

At this point, a wave washer 14 which is a ring-shaped thrust bearing plate is provided in between the collar plate 16*b* and the yoke member 10. A flat washer 18*a* is provided in between the outer rotary hook 2 and the fixing portion 18 of the sewing machine frame.

Next, an assembly procedure of the horizontal full rotary hook 1 will be described with reference to FIG. 6.

First, the yoke member 10 is placed on the inner surface of the bottom wall 2*c* of the outer rotary hook 2 while being located to a predetermined location by 6 rib pieces 2*e* arranged in annular form. At this point, as shown in FIG. 3, the protrusions 10*d* are arranged in the spaces between the rib pieces 2*e*. Next, the shaft body 16*a* of the outer rotary hook shaft 16 is inserted from above into the shaft slot 2*d* of the outer rotary hook 2 with the wave washer 14 placed on the upper side of the bottom wall 10*b* of the yoke member 10. Then, the flat washer 18*a* is placed in between the outer rotary hook 2 and the fixing portion 18 of the sewing machine frame and the lower end of the outer rotary hook shaft 16 inserted into the shaft slot 2*d* of the outer rotary hook 2 is fixed to the fixing portion 18 by the screw 19. After that, the ring-shaped magnet piece 12 is fitted into the yoke member 10.

Then, the inner rotary hook 3 is housed in the outer rotary hook 2 by adjusting the placement of the outer circumference of the inner rotary hook 3 on the race surface 2*b* of the outer rotary hook 2. Thus, the assembly of the horizontal rotary hook 1 is completed (refer to FIG. 5). At this point, as shown in FIGS. 5 and 7, the adsorption plate 8 on the outer bottom surface of the inner rotary hook 3 and the yoke member 10 housing the magnet piece 12 are arranged in an opposing manner, slightly spaced apart from one another.

Next, the operation and effect of the horizontal full rotary hook 1 having the above construction will be described.

In the horizontal full rotary hook 1 having the above construction, since the adsorption plate 8 is provided on the outer surface of the bottom wall 3*e* of the inner rotary hook 3 and the magnet piece 12 is housed in the yoke member 10 in the inner surface of the bottom wall 2*c* of the outer rotary hook 2, the magnetic attraction of the inner rotary hook 3 with respect to the outer rotary hook 2 can be increased.

More specifically, as shown in FIG. 7, a magnetic path M is defined between the magnet piece 12 and the adsorption plate 8, extending from the top surface (N pole) of the magnet piece 12 to the bottom surface (S pole) via the adsorption plate 8, surrounding wall 10*c* and the bottom wall 10*b* of the yoke member 10. Therefore, the magnetic lines of force are concentrated amongst the foregoing and the adsorption of the magnet piece 12 with respect to the adsorption plate 8 by the magnetic power of the magnet piece 12, that is, the pull of the magnet piece 12 with respect to the inner rotary hook 3 is increased. Hence, the floating of the inner rotary hook 3 from the outer rotary hook 2 is effectively prevented.

Also, by achieving the increase of magnetic attractions the size or the thickness of the magnet piece 12 can be relatively reduced. As for the yoke member 10, since the yoke member 10 is made of a thin plate covering the surroundings and the bottom surface of the magnet piece 12, the yoke member 10 and the magnet piece 12 taken together will not lead to much size increase. Consequently, the size increase of the magnet piece 12 and the outer rotary hook 2 can be prevented.

In the present embodiment, the ribs 2*e* are integrally formed on the bottom wall 2*c* of the outer rotary hook 2 to locate the yoke member 10, moreover, the rotation of the yoke member 10 is prevented by the ribs 2*e* and furthermore, the yoke member 10 is locked to prevent an upward dislocation by the collar plate 16*b* of the outer rotary hook shaft 16. Hence, the assembly of the yoke member 10 and the magnet piece 12 is simplified without requiring any extra part for assembly or rotation restriction purposes, thereby providing simplified construction. As opposed to adhering the magnet by an adhesive agent or an adhesive tape, the dislocation of the yoke member 10 or magnet piece 12 can be prevented.

Also, since the wave washer 14 is provided in between the collar plate 16*b* and the yoke member 10, wear-out and rattling of the slide contacting portion of the collar plate 16*b* and the yoke member 10 can be prevented and a smooth rotation of the outer rotary hook 2 (yoke member 10) with respect to the outer rotary hook shaft 16 is enabled.

Next, transformations of the aforementioned embodiment are described.

The present invention is not limited to the horizontal full rotary hook 1 wherein a outer rotary hook 2 housing a inner rotary hook 3 is rotationally driven to the predetermined direction, but may also be applied to horizontal rotary hooks in general such as a shuttle hook.

Also, in the above embodiment, six ribs 2*e* are provided in the inner surface of the bottom wall 2*c* of the outer rotary hook 2 as well as providing the protrusions 10*d* to the outer circumference of the yoke member 10. However, it is not limited to such arrangement. That is, annular ribs formed with protrusions protruding towards the inner circumference can be provided in the inner surface of the bottom wall 2*c* of the outer rotary hook 2 as well as providing notches on the surrounding wall 10*c* of the yoke member 10 so that the protrusions can be locked to the notches.

Furthermore, in the above embodiment, the adsorption plate 8 is provided on the outer surface of the bottom wall 3*e* of the inner rotary hook 3 and the magnet piece 12 and the yoke member 10 is provided in the inner surface of the bottom wall 2*c* of the outer rotary hook 2. However, the magnet piece 12 and the yoke member 10 can be provided on the outer surface of the bottom wall 3*e* of the inner rotary hook 3 and the adsorption plate 8 can be provided on the inner surface of the bottom wall 2*c* of the outer rotary hook 2.

Furthermore, the yoke member 10 and the magnet piece 12 housed therein can be formed in a shape other than the ring shape. That is, the contours of the yoke member 10 and the magnet piece 12 can be formed in a quadrilateral, a triangle or a polygon in flat view.

Also, the thrust bearing plate may be integrally formed in the yoke member 10 and the wave washer 14 may be omitted, for further reduction in the number of parts.

The assembly procedure of the horizontal full rotary hook 1 should not be limited to the above-described. For example, the magnet piece 12 may be fitted into the yoke member 10 in advance. Thus, the above-described assembly procedure may be changed and reduced to practice accordingly.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

We claim:

1. A horizontal rotary hook of a sewing machine comprising:

an inner rotary hook made of synthetic resin and housing a bobbin;

an outer rotary hook made of synthetic resin and housing the inner rotary hook and rotated in a predetermined direction;

an adsorption plate made of a magnetic material and provided on one of an outer surface of a bottom wall of the inner rotary hook and an inner surface of a bottom wall of the outer rotary hook;

a magnet piece formed as a thin plate and provided in the other of the outer surface of the bottom wall of the inner rotary hook and the inner surface of the bottom wall of the outer rotary hook; and a yoke member made of a magnetic material and housing the magnet piece integrally formed with a bottom wall contacting the magnet piece and a surrounding wall surrounding an outer circumferential side of the magnet piece, the yoke member being provided on the other of the outer surface of the bottom wall of the inner rotary hook and the inner surface of the bottom wall of the outer rotary hook.

2. The horizontal rotary hook of a sewing machine according to claim 1, wherein the adsorption plate is provided on the outer surface of the bottom wall of the inner rotary hook and the magnet piece and the yoke member are provided on the inner surface of the bottom wall of the outer rotary hook.

3. The horizontal rotary hook of a sewing machine according to claim 2, wherein the outer rotary hook is rotatably supported by an outer rotary hook shaft fixed to a sewing machine frame while the yoke member is locked by a collar plate formed on the outer rotary hook shaft such that the yoke member is unmovable to an axial direction of the outer rotary hook shaft fixed to the sewing machine frame.

4. The horizontal rotary hook of a sewing machine according to claim 2, further comprising ribs provided on the inner surface of the bottom wall of the outer rotary hook for locating the yoke member.

5. The horizontal rotary hook of a sewing machine according to claim 4, further comprising protrusions provided on the outer circumference of the yoke member for preventing rotation with respect to the outer rotary hook by being locked by the ribs.

6. The horizontal rotary hook of a sewing machine according to claim 3, wherein the magnet piece is formed in a ring shape and the collar plate is arranged on an inner circumferential portion of the magnet piece, the horizontal rotary hook further comprising a ring-shaped thrust bearing plate provided in between the collar plate and the yoke member.

* * * * *